US010728676B1

(12) United States Patent
El Guindi et al.

(10) Patent No.: US 10,728,676 B1
(45) Date of Patent: Jul. 28, 2020

(54) SYSTEMS AND METHODS FOR ACCELEROMETER-BASED OPTIMIZATION OF PROCESSING PERFORMED BY A HEARING DEVICE

(71) Applicant: SONOVA AG, Staefa (CH)

(72) Inventors: Nadim El Guindi, Zürich (CH); Ullrich Sigwanz, Hombrechtikon (CH); Thomas Wessel, Männedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/265,532

(22) Filed: Feb. 1, 2019

(51) Int. Cl.
*H04R 25/00* (2006.01)
*G10L 25/81* (2013.01)

(52) U.S. Cl.
CPC ..... *H04R 25/505* (2013.01); *G10L 25/81* (2013.01); *H04R 25/30* (2013.01); *H04R 25/43* (2013.01); *H04R 2225/41* (2013.01)

(58) Field of Classification Search
CPC combination set(s) only.
See application file for complete search history.

(56) References Cited

U.S. PATENT DOCUMENTS 9,613,028 B2 * 4/2017 Foo ..... G06F 40/58
2004/0213424 A1 * 10/2004 Hamacher ..... H04R 25/70 381/315
2005/0096898 A1 * 5/2005 Singhal ..... G10H 1/125 704/205
2008/0162121 A1 * 7/2008 Son ..... G10L 19/22 704/201
2010/0241256 A1 * 9/2010 Goldstein ..... H04R 5/04 700/94
2011/0200213 A1 * 8/2011 Knox ..... H04R 25/505 381/314
2013/0223660 A1 * 8/2013 Olafsson ..... H04R 25/407 381/313
2014/0161264 A1 * 6/2014 Kirkbak ..... G08B 21/182 381/56
2016/0246565 A1 * 8/2016 Shaheen ..... G06F 3/165
2018/0310104 A1 * 10/2018 Westergaard ..... H04R 25/70

FOREIGN PATENT DOCUMENTS

WO 2012/072141 6/2012

* cited by examiner

*Primary Examiner* — Duc Nguyen
*Assistant Examiner* — Assad Mohammed
(74) *Attorney, Agent, or Firm* — ALG Intellectual Property, LLC

(57) ABSTRACT

A hearing device configured to be worn by a user includes a microphone, an accelerometer, and a processor. The microphone detects an audio signal. The accelerometer outputs accelerometer data associated with the hearing device. The processor is configured to 1) identify a music feature of the audio signal, the music feature indicating that the audio signal includes music content, 2) identify a movement feature of the accelerometer data, the movement feature representative of movement by the user while the microphone detects the audio signal, 3) determine a similarity measure between the music feature and the movement feature, and 4) perform, based on the similarity measure, an operation with respect to a sound processing program executable by the processor.

16 Claims, 8 Drawing Sheets

SYSTEMS AND METHODS FOR ACCELEROMETER-BASED OPTIMIZATION OF PROCESSING PERFORMED BY A HEARING DEVICE

BACKGROUND INFORMATION

A hearing device may enable or enhance hearing by a user wearing the hearing device by providing audio content received by the hearing device to the user. For example, a hearing aid may provide an amplified version of the audio content to the user to enhance hearing by the user. As another example, a sound processor included in a cochlear implant system may provide electrical stimulation representative of the audio content to the user to enable hearing by the user.

To provide audio content to a user, a hearing device may selectively operate in accordance with different sound processing programs that each specify various parameters for processing audio content. Each of the sound processing programs may be optimized for a different type of audio content, such as music, speech, etc. In this manner, the user of the hearing device may select a sound processing program for the hearing device that is best suited for the particular type of audio content that the user desires to hear.

Unfortunately, a user may not always know which sound processing program is most appropriate for a particular environment or situation. Even if the hearing device is configured to automatically switch (e.g., without user input) to a particular sound processing program based on detected environmental cues, it is currently difficult or impossible for a conventional hearing device to ascertain a listening intention of the user and thereby select an appropriate sound processing program. For example, if the audio content includes both music and speech, a conventional hearing device cannot determine whether the user is more focused on the music than the speech or vice versa. Hence, a conventional hearing device may not always select the appropriate sound processing program for the user.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
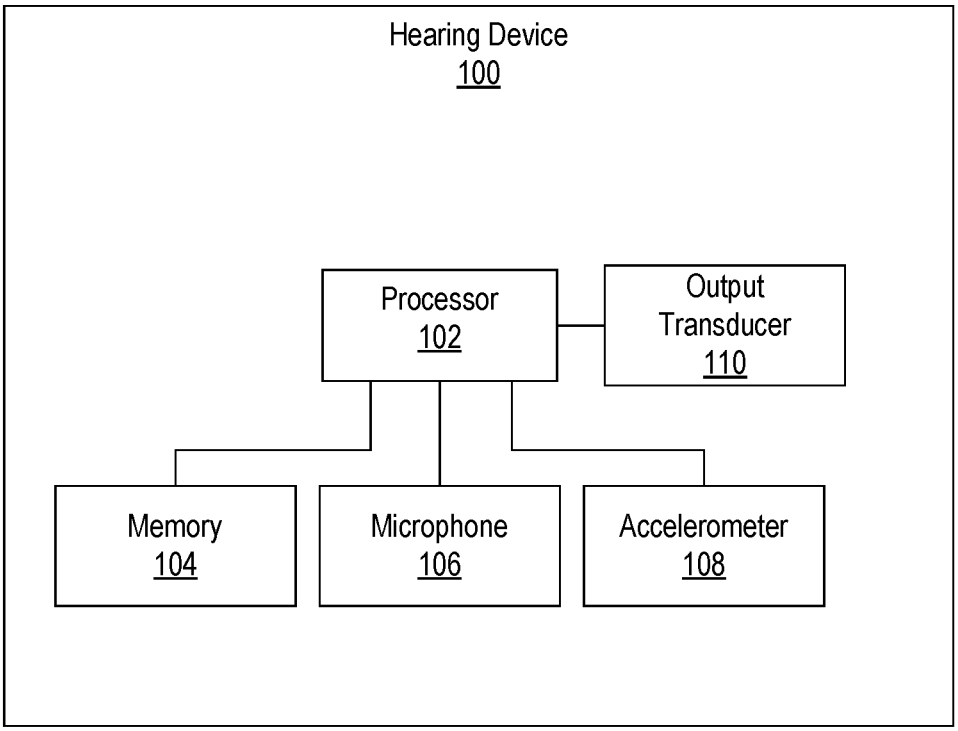
FIG. 1 illustrates an exemplary hearing device according to principles described herein.

Systems and methods for accelerometer-based optimization of processing performed by a hearing device are described herein. For example, as will be described herein, an exemplary hearing device is configured to be worn by a user and includes a microphone, an accelerometer, and a processor. The microphone is configured to detect an audio signal. The accelerometer is configured to output accelerometer data associated with the hearing device while the microphone detects the audio signal. The processor is configured to 1) identify a music feature of the audio signal, the music feature indicating that the audio signal includes music content, 2) identify a movement feature of the accelerometer data, the movement feature representative of movement by the user while the microphone detects the audio signal, 3) determine a similarity measure between the music feature and the movement feature, and 4) perform, based on the similarity measure, an operation with respect to a sound processing program executable by the processor.

To illustrate, a user of a hearing device may be located in an environment that includes both music and speech. Hence, the audio signal detected by a microphone of the hearing device may include both music content and speech content. Based on accelerometer data output by an accelerometer included in the hearing device, the hearing device (e.g., a processor included in the hearing device) may determine that the user is moving, for instance moving his/her head, tapping his/her feet, moving his/her body, with a periodicity that correlates with a periodicity of rhythmical components of the music content. Based on this determination, the hearing device may deduce a preference of the user related to the listening of music and may automatically initiate an operation related to sound processing. The operation can thus account for the music listening preference. The operation can comprise identifying settings for the sound processing program allowing an adaption of the sound processing program to the music content. The settings may then be applied to the sound processing program, for instance immediately after they have been identified by the processor or at a later time, when the user intends to listen to music. The settings may be stored in a memory such that they are available when the user chooses to listen to music at the later time. The user then may activate a music processing program comprising settings for the hearing device that are optimized for the music content. The operation can also comprise an automatic initiation of the music processing program optimized for the music content, lower a threshold for activation of the music processing program, and/or perform any other suitable operation with respect to the music processing program. The settings can also be forwarded to a service provider communicating with the processor, for instance a music downloading or streaming service. The settings can comprise a classification of the music content, such as a genre, a title, a performer, or a composer associated with the music content. The service provider can thus provide music content according to the classification to the sound processing program. To illustrate, a music content of the classification corresponding to preferences of other users of the service provider may be provided to the sound processing program by the service provider, or other selection criteria may be applied to provide the music content from the service provider. The settings can also comprise settings for an audio output of the hearing device that are optimized for the music content. For instance, a volume of the audio output or a proportion of the music content and a non-music content, such as ambient sound, in the audio output may be set by the operation.

As another example, an exemplary hearing device configured to be worn by a user includes a microphone configured to detect an audio signal, an accelerometer configured to output accelerometer data associated with the hearing device while the microphone detects the audio signal, and a processor communicatively coupled to the microphone and to the accelerometer. The processor is configured to 1) identify a movement feature of the accelerometer data, the movement feature indicative of an activity of the user while the microphone detects the audio signal, and 2) perform, based on the movement feature, an operation with respect to a sound processing program executable by the processor, the sound processing program comprising settings for the hearing device that are optimized for providing audio during the activity.

To illustrate, the movement feature of the accelerometer data may indicate that the user tilts his or her head towards a source that is outputting music content. In response to identifying this movement feature, the processor may lower a threshold to initiate a music processing program executable by the processor and/or perform any other suitable operation with respect to the music processing program.

By using accelerometer data in the ways described herein, the systems and methods described herein may determine a user's listening intention and accordingly optimize sound processing of an audio signal detected by a microphone of a hearing device. For example, based on accelerometer data that indicates that a user is engaged with music content included in an audio signal that includes both music content and non-music content, the systems and methods described herein may select a sound processing program configured to optimize the music content even if the non-music content is more dominant within the audio signal. This may provide an enhanced listening experience for the user.

Various embodiments will now be described in more detail with reference to the figures. The systems and methods described herein may provide one or more of the benefits mentioned above and/or various additional and/or alternative benefits that will be made apparent herein.

FIG. 1 illustrates an exemplary hearing device 100. Hearing device 100 may be implemented by any type of hearing device configured to enable or enhance hearing by a user wearing hearing device 100. For example, hearing device 100 may be implemented by a hearing aid configured to provide an amplified version of audio content to a user, a sound processor included in a cochlear implant system configured to provide electrical stimulation representative of audio content to a user, a sound processor included in a bimodal hearing system configured to provide both amplification and electrical stimulation representative of audio content to a user, or any other suitable hearing prosthesis.

As shown, hearing device 100 includes a processor 102 communicatively coupled to a memory 104, a microphone 106, an accelerometer 108, and an output transducer 110. Hearing device 100 may include additional or alternative components as may serve a particular implementation.

Microphone 106 may be implemented by any suitable audio detection device and is configured to detect an audio signal presented to a user of hearing device 100. The audio signal may include, for example, audio content (e.g., music, speech, noise, etc.) generated by one or more audio sources included in an environment of the user. Microphone 106 may be included in or communicatively coupled to hearing device 100 in any suitable manner. Output transducer 110 may be implemented by any suitable audio output device, for instance a loudspeaker of a hearing device or an output electrode of a cochlear implant system.

Accelerometer 108 may be implemented by any suitable sensor configured to detect movement (e.g., acceleration) of hearing device 100. While hearing device 100 is being worn by a user, the detected movement of hearing device 100 is representative of movement by the user. In some examples, accelerometer 108 is configured to output accelerometer data associated with hearing device 108 while microphone 106 detects an audio signal. The accelerometer data is representative of movement of hearing device 100 (and hence, of the user) while the audio signal is being presented to the user. For example, the accelerometer data may be representative of movement of the user's head (e.g., a nodding motion), the user's body (e.g., a dancing motion), or the user's feet (e.g. a tapping motion) while the user is listening to music content included in the audio signal detected by microphone 106.

In some examples, accelerometer 108 is included in hearing device 100. Alternatively, accelerometer 108 may be included in a different device (e.g., a watch or a mobile phone worn or carried by the user). In these alternative configurations, hearing device 100 may access accelerometer data generated by accelerometer 108 by being communicatively coupled to the different device.

Memory 104 may be implemented by any suitable type of storage medium and may be configured to maintain (e.g., store) data generated, accessed, or otherwise used by processor 102. For example, memory 104 may maintain data representative of a plurality of sound processing programs that specify how processor 102 processes audio content (e.g., audio content included in the audio signal detected by microphone 106) to present the audio content to a user. Memory 104 may also maintain data representative of settings for the sound processing program as described in more detail herein. To illustrate, if hearing device 100 is a hearing aid, memory 104 may maintain data representative of sound processing programs that specify audio amplification schemes (e.g., amplification levels, etc.) used by processor 102 to provide an amplified version of the audio content to the user. As another example, if hearing device 100 is a sound processor included in a cochlear implant system, memory 104 may maintain data representative of sound processing programs that specify stimulation schemes used by processor 102 to direct a cochlear implant to provide electrical stimulation representative of the audio content to the user.

In some examples, each sound processing program maintained by memory 104 may be optimized for a different type of audio content. For example, memory 104 may maintain data representative of a music processing program that includes settings for hearing device 100 (e.g., processor 102) that are optimized for music content, a speech processing program that includes settings for hearing device 100 that are optimized for speech content, a sound processing program that includes settings for hearing device 100 that are optimized for noisy environments, a sound processing program that includes settings for hearing device 100 that are optimized for quiet environments, and/or any other type of sound processing program as may serve a particular implementation.

Processor 102 may be configured to perform various processing operations with respect to an audio signal detected by microphone 106. For example, processor 102 may be configured to receive the audio signal (e.g., a digitized version of the audio signal) from microphone 106 and process the audio content contained in the audio signal in accordance with a sound processing program to present the audio content to the user.

Processor 102 may be further configured to access accelerometer data generated by accelerometer 108. Processor 102 may use the accelerometer data to optimize an operation of hearing device 100 for the user. For example, processor 102 may identify a music feature and a non-music feature of the audio signal detected by microphone 106, identify a movement feature of the accelerometer data generated by accelerometer 108, determine a similarity measure between the music feature and the movement feature, and perform, based on the similarity measure, an operation with respect to a music processing program executable by processor 102. As another example, processor 102 may identify a movement feature of the accelerometer data generated by accelerometer 108, identify, based on the movement feature, an activity being performed by the user while microphone 106 detects the audio signal, and perform an operation with respect to a sound processing program executable by processor 102 and comprising settings for hearing device 100 that are optimized for providing audio during the activity. These and other operations that may be performed by processor 102 are described in more detail herein. In the description that follows, any references to operations performed by hearing device 100 may be understood to be performed by processor 102 of hearing device 100.

Figure 2:
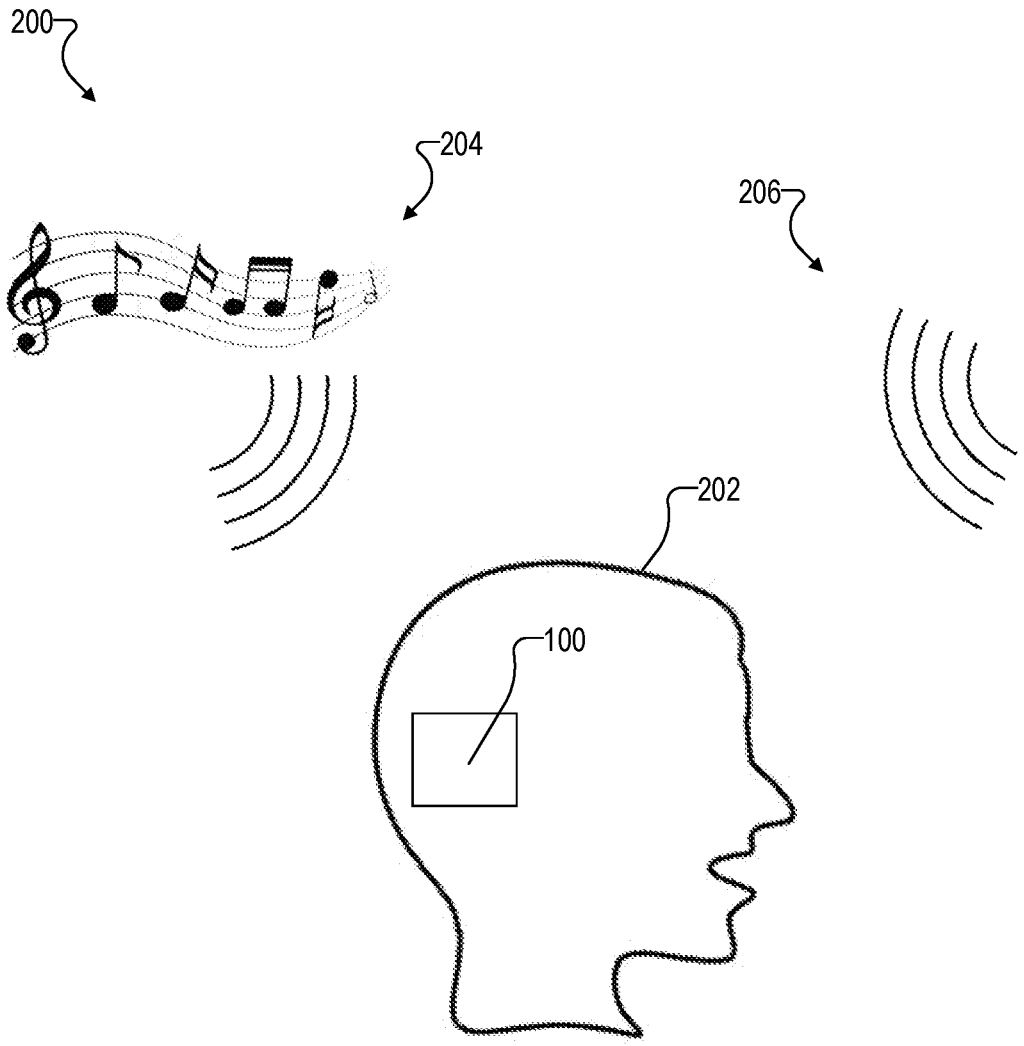
FIG. 2 illustrates an exemplary environment of the hearing device illustrated in FIG. 1 according to principles described herein.

FIG. 2 illustrates an exemplary environment 200 in which hearing device 100 is worn by a user 202 to enable or enhance hearing by user 202. As shown, environment 200 includes both music content 204 and non-music content 206. Music content 204 includes sound representative of music and may be generated by any suitable source (e.g., a person, an electronic speaker, etc.) in environment 200. Non-music content 206 includes sound not categorized as music (e.g., speech, background noise, etc.) and may be generated by any suitable source in environment 200. In environment 200, microphone 106 of hearing device 100 detects an audio signal that includes both music content 204 and non-music content 206.

At any given time, user 202 may focus his or her listening attention more on music content 204 than on non-music content 206. Likewise, at any given time, user 202 may focus his or her listening attention more on non-music content 206 than on music content 204. Hearing device 100 may be configured to determine, based on accelerometer data output by accelerometer 108, which type of content user 202 is more focused on and accordingly optimize how hearing device 100 processes the audio signal detected by microphone 106.

For example, as described herein, if the accelerometer data indicates that the user moves (e.g., for a threshold amount of time) in a manner indicative of an intention to listen to music content 204. This can indicate a certain preference of the user for the music content. The hearing device 100 may then select a music processing program for execution and/or perform one or more other operations with respect to the music processing program while the audio signal is being detected by microphone 106 or after detection of the audio signal. The operation can comprise identifying settings for the music processing program which enable an adaption of the music processing program to the music content, for instance such that the hearing device can be optimized for the music content with respect to music preferences of the user. The settings can then be applied in the music progressing program and/or stored in memory 104 such that they can be accessed by the music progressing program at a later time. Additionally or alternatively, the settings may be forwarded to a service provider communicating with the processor in order to provide music services related to the music content. Examples for such a service provider are music streaming or downloading services (e.g., Spotify or Apple Music) to which the hearing device can connect for receiving the music content processed by the music processing program. In particular, the settings forwarded to the service provider can comprise a classification of the music content, as described in more detail herein, allowing a selection of music content corresponding to the classification by the service provider. Alternatively, if the accelerometer data indicates that the user 202 is not moving in a manner indicative of an intention to listen to music content 204, hearing device 100 may select a non-music processing program for execution and/or perform one or more other operations with respect to the non-music processing program while the audio signal is being detected by microphone 106.

In some examples, hearing device 100 may determine that the user is subconsciously moving his or her body to the beat of music while the user is actively engaged in a different activity. For example, hearing device 100 may, based on accelerometer data and on audio content detected by microphone 106, determine that the user is subconsciously moving his or her body to the beat of music while the user is actively engaged in speaking with another person. In this scenario, the user is not interested in actively listening to the music because he or she is involved in the conversation. Hearing device 100 may accordingly forward the music content to a music identification service (e.g., SHAZAAM) to identify the title and artist of the music content. These classification settings may be stored in memory 104 such that the same or a related title (e.g., of the same genre/artist) can be played later when the user decides to listen to music. In some examples, the classification settings may be sent to a music streaming or download service (e.g., Spotify or Apple Music), which may be used to identify and/or otherwise select related music titles for presentation to the user.

Figure 3:
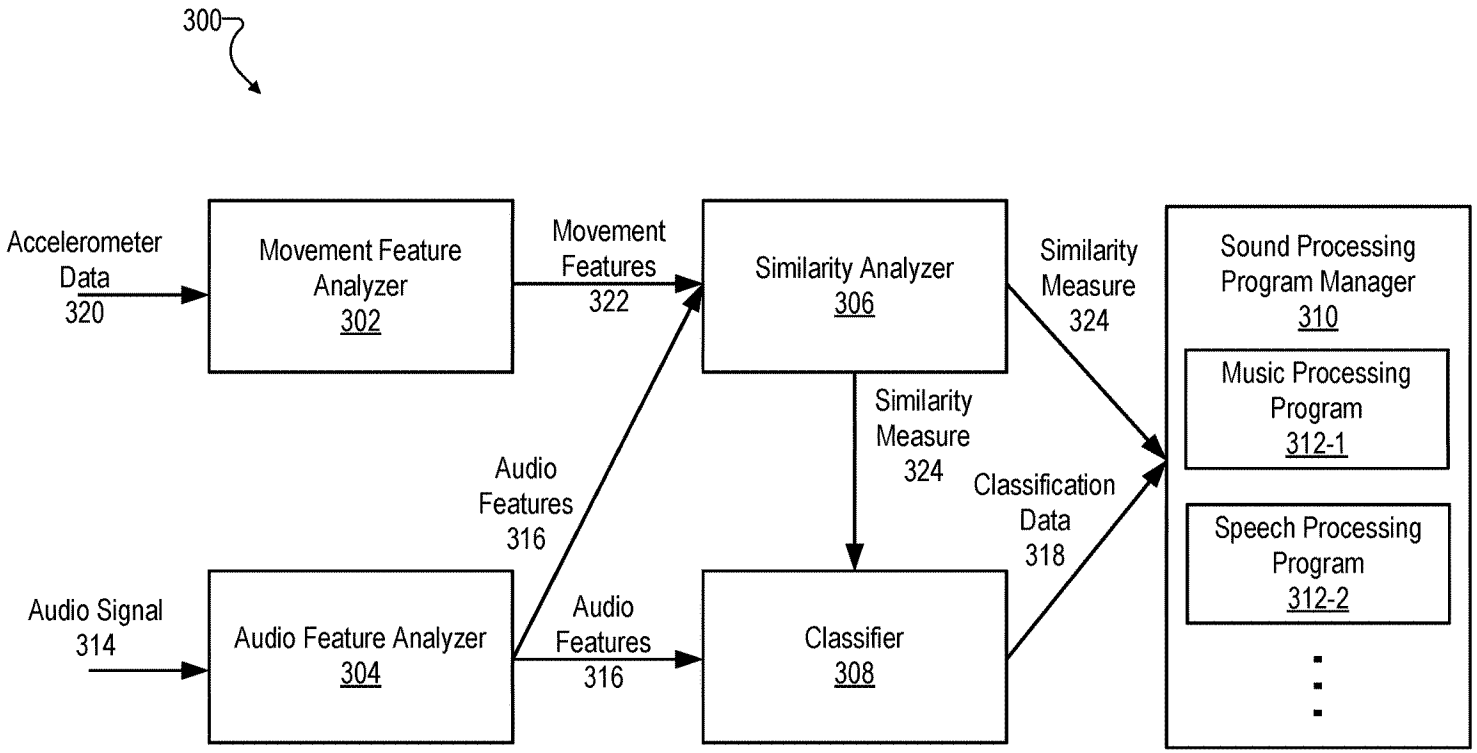
FIG. 3 illustrates an exemplary audio signal processing configuration that may be implemented by the hearing device illustrated in FIG. 1 according to principles described herein.

FIG. 3 illustrates an exemplary audio signal processing configuration 300 that may be implemented by hearing device 100. As shown, configuration 300 includes a movement feature analyzer 302, an audio feature analyzer 304, a similarity analyzer 306, a classifier 308, and a sound processing program manager 310. Sound processing program manager 310 manages (e.g., by maintaining and/or accessing) a plurality of sound processing programs that may executed by hearing device 100 to process an audio signal detected by microphone 106 of hearing device 100. For example, as shown, sound processing program manager 310 manages a music processing program 312-1, a speech processing program 312-2, and various other sound processing programs.

As shown, audio feature analyzer 304 may receive (e.g., detect via microphone 106) an audio signal 314. In some examples, audio signal 314 only includes music content (e.g., music content 204). In other examples, audio signal 314 only includes non-music content (e.g., non-music content 206). In yet other examples, audio signal 314 includes both music content and non-music content.

Audio feature analyzer 304 may analyze audio signal 314 to identify audio features 316 in audio signal 314. Audio features 316 may include music features indicative of audio signal 314 including music content and/or non-music features indicative of audio signal 314 including non-music content. Exemplary music features include, but are not limited to, rhythms, periodicities, harmonic structures, etc. that are representative of music content. Exemplary non-music features include non-harmonic structures, non-rhythmic content, non-periodic content, and/or any other feature representative of speech, noise, and/or other non-music content.

Audio features 316 may be identified using any suitable audio analysis algorithm. For example, audio feature analyzer 304 may identify music features and non-music features in audio signal 314 using one or more algorithms that identify and/or use zero crossing rates, amplitude histograms, auto correlation functions, spectral analysis, amplitude modulation spectrums, spectral centroids, slopes, roll-offs, auto correlation functions, etc.

Classifier 308 may receive audio features 316 and, based on audio features 316, classify the audio signal 314 as including one or more types of content. For example, classifier 308 may classify audio signal 314 as including music content and/or non-music content. In some examples, classifier 308 may further classify audio signal 314 as including particular types of music content (e.g., music genres, music titles, performers, composers associated with the music content), particular types of non-music content (e.g., speech and/or noise), particular environment or activity types (e.g., inside a car, in traffic, outdoors, in nature, etc.), and/or any other suitable category of content. In some examples, classifier 308 is configured to output classification data 318 representative of one or more classifications of audio signal 314.

As shown, sound processing program manager 310 may receive classification data 318 from classifier 308. Sound processing program manager 310 may use classification data 318 to perform an operation with respect to one or more sound processing programs managed by sound processing program manager 310.

For example, sound processing program manager 310 may use classification data 318 to select a particular sound processing program for execution by hearing device 100. To illustrate, if classification data 318 indicates that audio signal 314 only includes music content, sound processing program manager 310 may select music processing program 312-1 for execution by hearing device 100. Sound processing program manager 310 may also use classification data 318 to select a particular music content to be processed by the sound processing program for execution by hearing device 100. Alternatively, if classification data 318 indicates that audio signal 314 only includes non-music content, sound processing program manager 310 may select speech processing program 312-2 or any other sound processing program optimized for non-music content for execution by hearing device 100.

In addition to classification data 318, sound processing program manager 310 may take into account other parameters when determining which operation to perform with respect to the sound processing programs managed by sound processing program manager 310. For example, in combination with classification data 318, sound processing program manager 310 may take into account a volume level of audio signal 314 (and/or a volume level of different types of content included in audio signal 314), time (e.g., sound processing program manager 310 may select music processing program 312-1 after a threshold amount of time elapses of continued identifying of music features in audio signal 314), and/or other suitable thresholds. To illustrate, an example combination of thresholds for selecting music processing program 312-1 for processing by hearing device 100 may include an 80% relative volume level with a 20 second threshold time so that sound processing program manager 310 selects music processing program 312-1 if audio feature analyzer 304 detects music features in audio signal 314 that meet these threshold levels.

As mentioned, audio signal 314 may, in some cases, include both music content and non-music content. In these cases, classification data 318 may indicate that audio signal 314 is classified as both music content and non-music content. Hence, in accordance with the systems and methods described herein, sound processing program manager 310 may also use accelerometer data to determine what operation to perform with respect to the sound processing programs maintained by sound processing program manager 310.

For example, as shown, movement feature analyzer 302 may receive accelerometer data 320 (e.g., from accelerometer 108 of hearing device 100 and/or an accelerometer included in another device being used by the user). Movement feature analyzer 302 may analyze accelerometer data 320 to identify one or more movement features 322 of accelerometer data 320 that represent movement by the user. Movement features may include any characteristic or property of accelerometer data 320 that indicates movement, such as periodicity, direction, modulation frequency, etc.

As shown, movement feature analyzer 302 may provide movement features 322 to similarity analyzer 306. Audio feature analyzer 304 may also provide audio features 316 to similarity analyzer 306. Similarity analyzer 306 may correlate audio features 316 with movement features 322 to determine a similarity measure 324. For example, audio features 316 may include a rhythm or rhythmical features (e.g., in an amplitude modulation spectrum) of audio signal 314. Similarity analyzer 306 may correlate the rhythm or rhythmical features of audio signal 314 with rhythmical features of movement features 322 (e.g., a modulation frequency in accelerometer data 320) to determine similarity measure 324. For example, if the user is moving his/her head (and/or other parts of the body) with a periodicity that correlates with a periodicity of rhythmical components of music content included in audio signal 314, such movement may be a strong indication that the user intends to listen to the music content even if audio signal 314 also includes non-music content. The movement may also be an indication that the user has a listening preference for the music content even if the user is not interested in listening to music at the moment. In this instance, rhythmical features of audio features 316 would correlate strongly with movement features 322 identified by movement feature analyzer 302 and provide a relatively strong or high similarity measure 324.

Conversely, as another example, the user may intend to not listen to the music content in audio signal 314. In this example, movement features 322 may be uncorrelated to music features of audio features 316. For example, if the user's movements are not related to rhythmical components of the music content or if the user is not moving, the user may be not paying attention to the music content.

Similarity analyzer 306 may provide similarity measure 324 to sound processing program manager 310. Sound processing program manager 310 may use similarity measure 324 together with classification data 318 to perform an operation with respect to a sound processing program, such as music processing program 312-1. For example, based on classification data 318 indicating that audio signal 314 includes music content and non-music content, and on similarity measure 324 being above a threshold similarity level for a predetermined amount of time, sound processing program manager 310 may select (e.g., initiate or activate) music processing program 312-1 and/or identify settings of music processing program 312-1. Based on the settings, music processing program 312-1 can be adapted to the music content during execution at any time.

As another example, sound processing program manager 310 may adjust a threshold for selecting a sound processing program (e.g., music processing program 312-1) based on a value or magnitude of similarity measure 324. To illustrate, if similarity measure 324 is above a threshold similarity level (thereby indicating a strong correlation between user movement and the music content), sound processing program manager 310 may lower a threshold relative volume level of the music content in audio signal 314. As described herein, this threshold relative volume level represents a volume level of the music content that may be required for hearing device 100 to initiate music processing program 312-1. For example, a default threshold relative volume level may be set to 50%, so that sound processing program manager 310 will activate music processing program 312-1 when the music content is at least as loud as the non-music content. However, if similarity measure 324 indicates a strong correlation between user movement and the music content, sound processing program manager 310 may adjust the threshold relative volume level to a lower value (e.g., 30% or 15%) or set the threshold relative volume level to the current relative volume level of the music content.

In contrast, if similarity measure 324 is below the threshold similarity level (thereby indicating a low correlation between user movement and the music content), sound processing program manager 310 may raise the threshold relative volume level of the music content in audio signal 314. In this manner, even if the volume level of the music content becomes relatively high compared to the volume level of the non-music content, sound processing program manager 310 may not select music processing program 312-1 for execution by hearing device 100 because the user is more focused on the non-music content.

In some examples, sound processing program manager 310 may use accelerometer data 320 generated over time (e.g., multiple days) to learn a preferred music taste of the user and adjust a manner in which sound processing program manager 310 performs an operation with respect to a particular sound processing program. For example, sound processing program manager 310 may identify a pattern of similarity measures that are above a particular threshold for a certain genre of music and determine, based on the pattern, that the user likes the certain genre of music. Sound processing program manager 310 may accordingly lower an activation threshold for a sound processing program optimized for the particular genre, adjust one or settings of a general music processing program to be more optimized for the particular genre, etc.

In some examples, classifier 308 may use accelerometer data 320 generated over time to adjust a classification of certain types of audio content accordingly. For example, as shown, classifier 308 may receive similarity measure 324 (which is based on accelerometer data 320) as an input. Over time, a pattern of similarity measure 324 associated with music content classified as being a particular genre may be below a particular threshold. Based on this, classifier 308 may reclassify the genre as non-music content instead of music content.

Figure 4A:
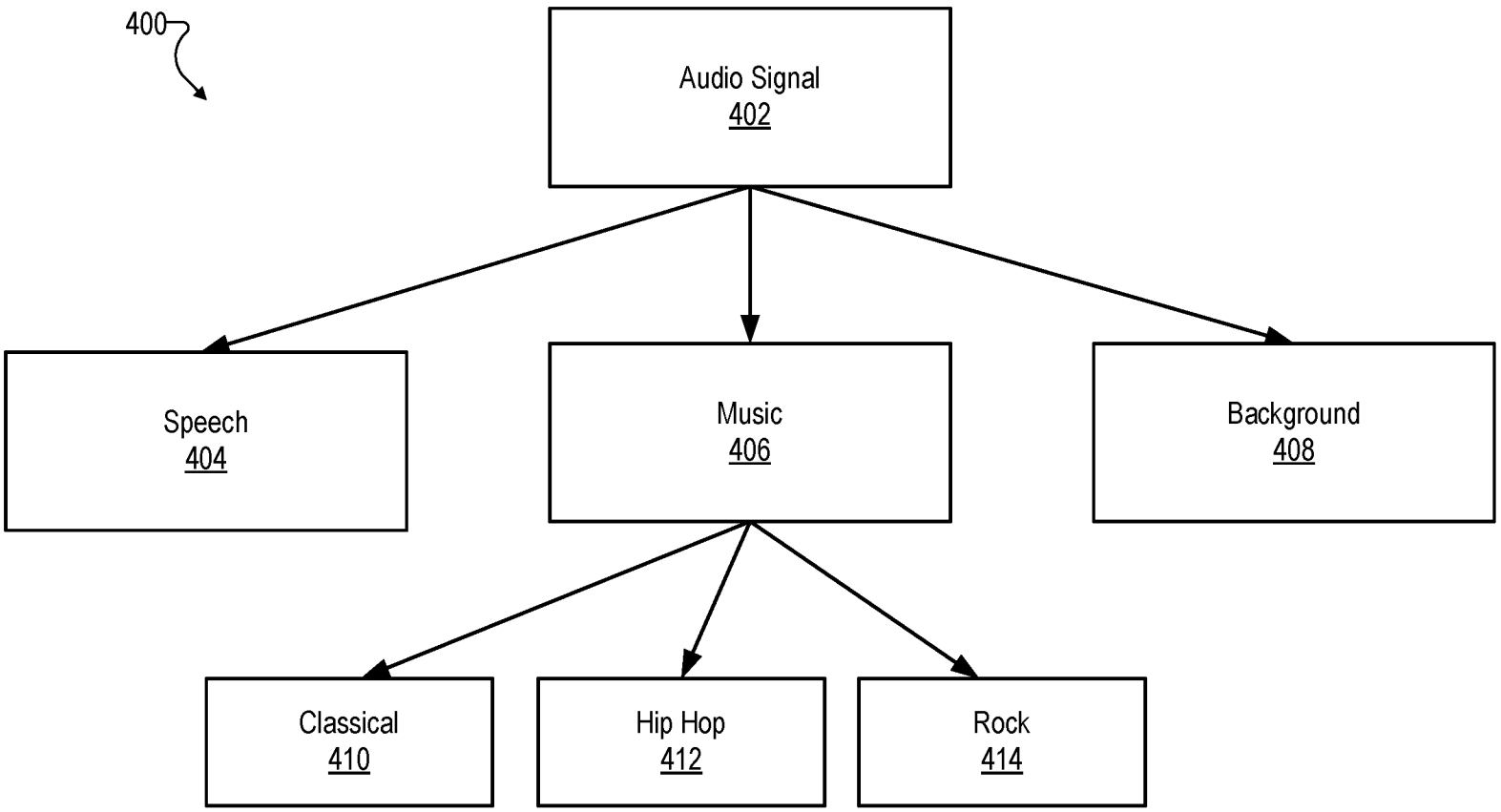
FIGS. 4A-4B illustrate an example of reclassifying audio content based on accelerometer data according to principles described herein.

To illustrate, FIG. 4A shows a classification tree 400 that may be used by classifier 308 to classify an audio signal 402 (e.g., any of the audio signals described herein). As shown, audio signal 402 may be classified as speech content 404, music content 406, and/or background content 408 (e.g., noise). Music content 404 may be further classified into genres, such as classical music 410, hip hop music 412, and rock music 414. Other classifications can comprise, for instance, a title, a performer, and a composer associated with the music content.

Figure 4B:
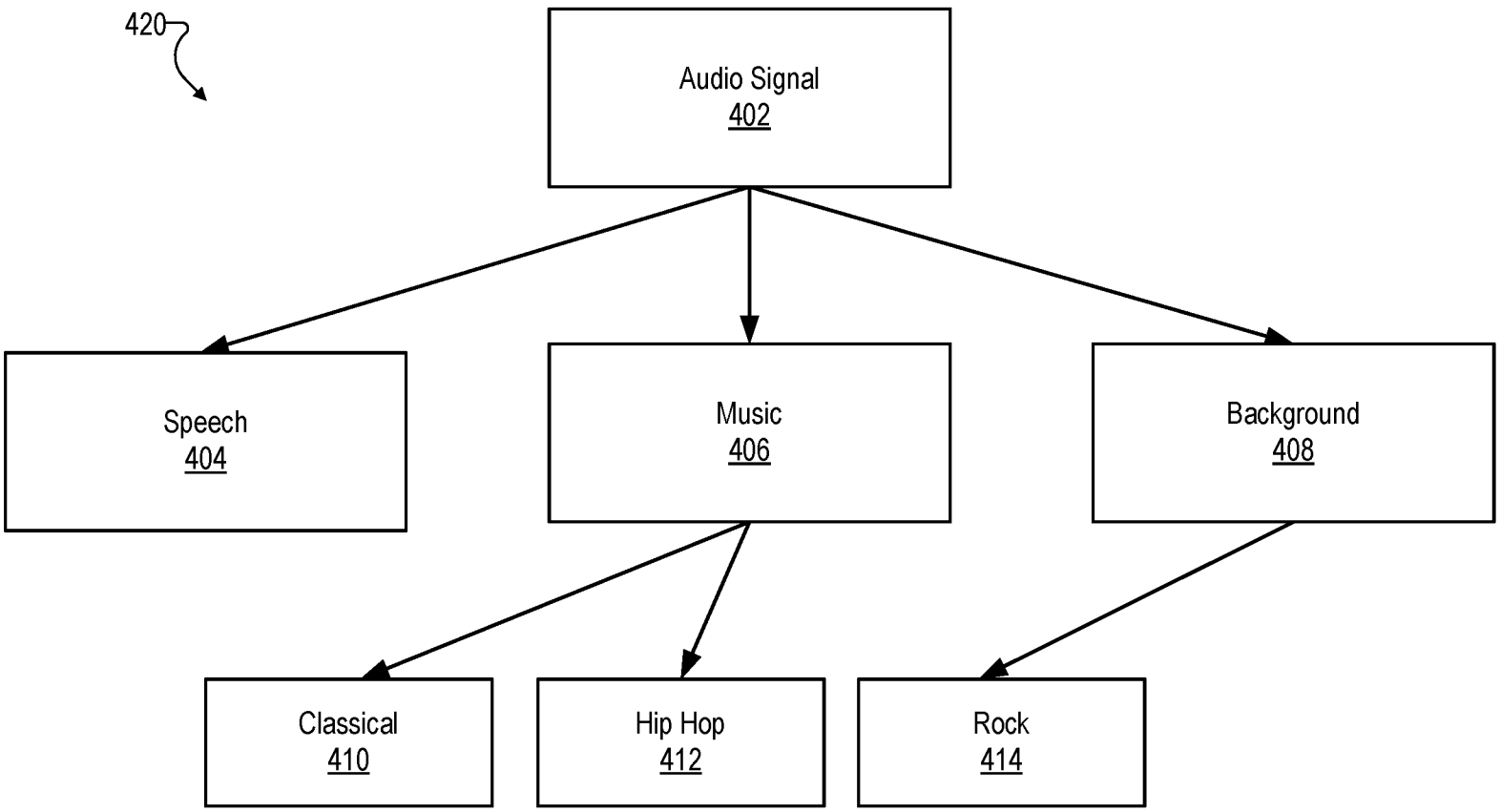

For a particular user, classifier 308 may identify a pattern of similarity measures that is below a particular threshold for music content classified as rock music 414. This may indicate that the user rarely or never moves in a manner that is correlated with rock music 414 when rock music 414 is presented to the user. Accordingly, classifier 308 may adjust a rule set that is used to classify rock music 414 so that rock music 414 is classified as being background content 408 instead of music content 406. For example, FIG. 4B shows an adjusted classification tree 420 that may be used by classifier 308 instead of classification tree 400. As shown, rock music 414 is now classified as background content 408. In accordance with adjusted classification tree 420, hearing device 100 may not activate a music processing program when rock music 414 is determined to be included in audio signal 404 and/or apply settings in the music processing program according to which rock music 414 is reproduced by the music processing program.

Figure 5A:
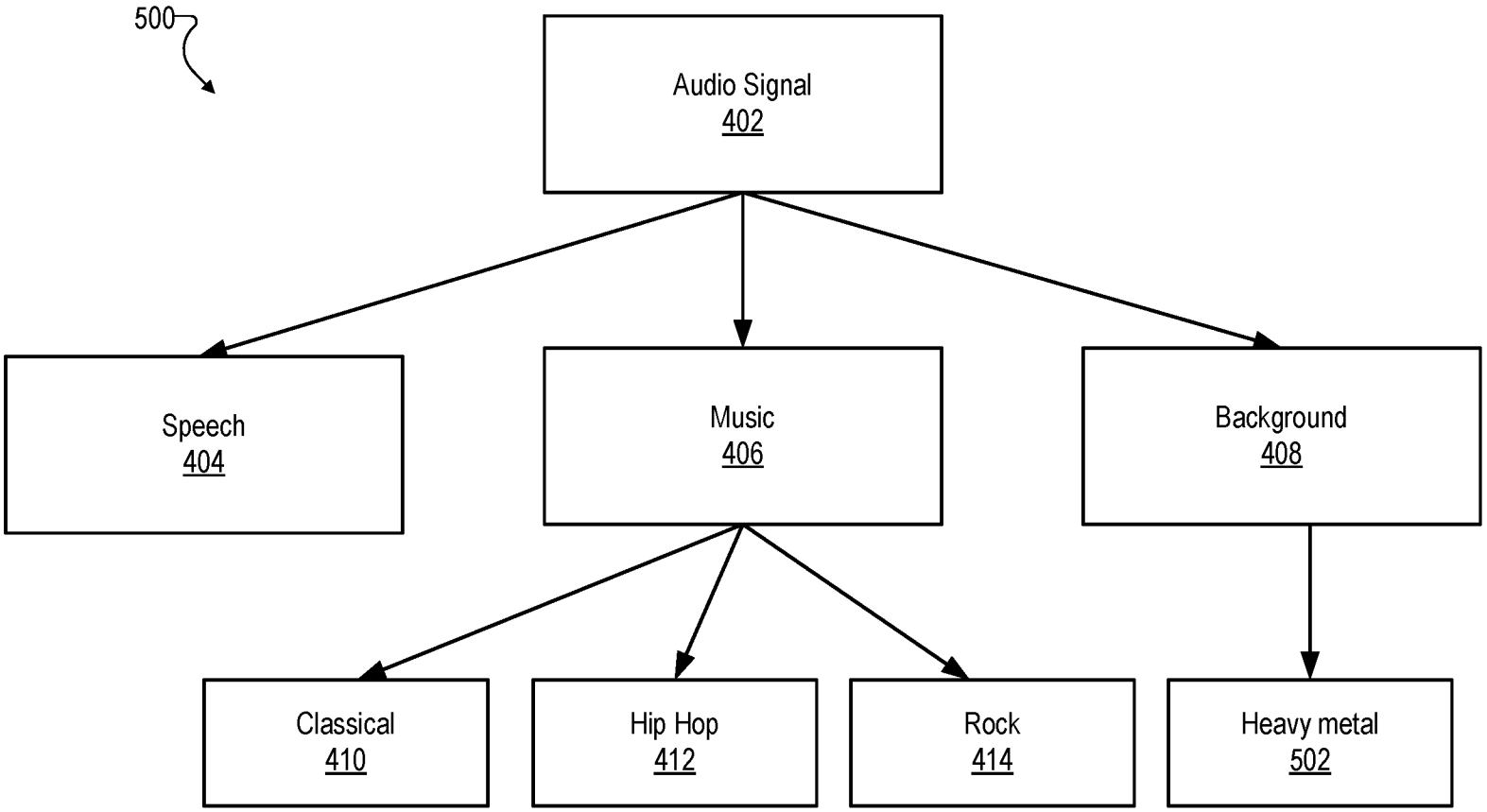
FIGS. 5A-5B illustrate another example of reclassifying audio content based on accelerometer data according to principles described herein.
Figure 5B:
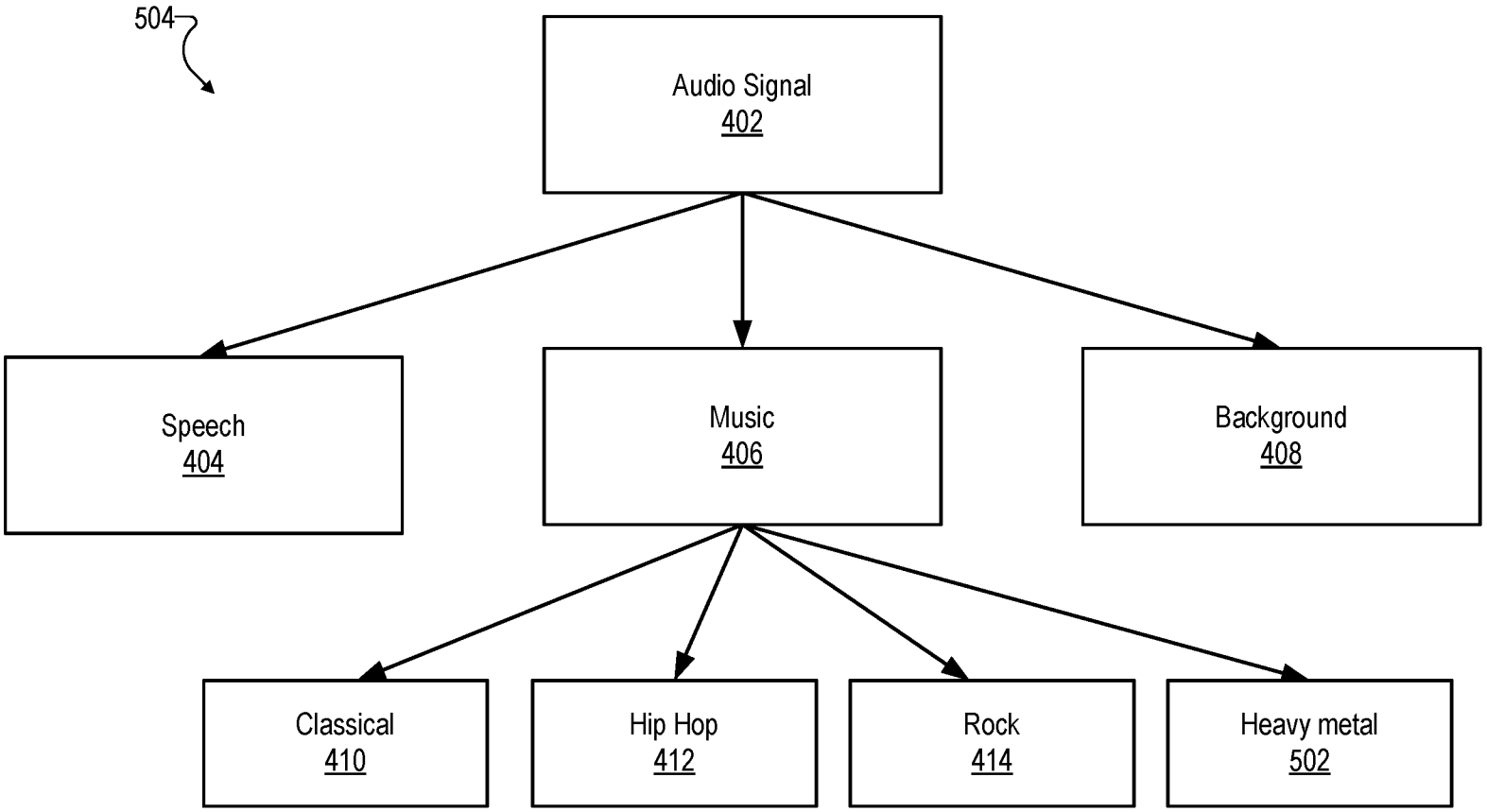

FIGS. 5A-5B illustrate another example of reclassifying audio content based on accelerometer data 320. FIG. 5A shows a classification tree 500 is similar to classification tree 400, but that may initially classify sound representative of heavy metal music 502 as background content 408. However, over time, classifier 308 may identify a pattern of similarity measures that is above a particular threshold for non-music content that includes heavy metal music 502. Based on this pattern, and optionally on one or more music identification services (e.g., SHAZAAM) and/or music identification algorithms, classifier 308 may reclassify heavy metal music 502 as a genre of music content 406. For example, FIG. 5B shows an adjusted classification tree 504 that may be used by classifier 308 instead of classification tree 500. As shown, heavy metal music 502 now classified as a genre of music content 406 instead of background content 408. In accordance with adjusted classification tree 504, hearing device 100 may activate a music processing program when heavy metal music 502 is determined to be included in audio signal 404 and/or apply settings in the music processing program according to which heavy metal music 502 is reproduced by the music processing program.

While examples herein have described performing operations with respect to music processing programs, in some examples, hearing device 100 may use accelerometer data to perform operations with respect to other types of sound processing programs. For example, a particular sound processing program may be optimized for a particular activity being performed by a user. To illustrate, a particular sound processing program may be optimized for the user while riding a car, running, biking, doing housework, etc. Accelerometer data may be analyzed to identify one or more movement features indicative of an activity of the user. The hearing device may perform, based on the one or more movement features, one or more operations with respect to a sound processing program optimized for that activity.

As an example, accelerometer data may indicate that the user moves relative to a source of music content and/or relative to a source of non-music content. Movement toward a source of music content (e.g., by the user tilting his or her head toward the source of music content) may indicate that the user intends to listen to the music content. Conversely, movement away from a source of music content and/or toward a source of non-music content may indicate the user intends to not listen to the music content and/or intends to listen to the non-music content. Based on such movement features, the hearing device may perform operations with respect to a music processing program or other sound processing programs.

In some examples, hearing device 100 may filter the accelerometer data before the accelerometer data is used to perform an operation with respect a sound processing program. For example, the accelerometer data may include data representative of a baseline amount or type of movement specific to a user. To illustrate, if a user fidgets regularly or has a regular baseline pattern of movement (e.g., a user with a tremor, Parkinson's, etc.), hearing device 100 may filter data representative of such movement out of the accelerometer data prior to determining a similarity measure between a movement feature of the accelerometer data and a movement feature of audio signal 314. For example, the hearing device may receive baseline accelerometer data (e.g., accelerometer data associated with hearing device 100 while microphone 106 detects substantially no audio signal). Based on the baseline accelerometer data, hearing device 100 may identify a baseline movement feature (e.g., tremors). Hearing device 100 may filter the baseline movement feature out of the accelerometer data when identifying movement features for determining the user's listening intentions for optimizing sound processing.

Figure 6:
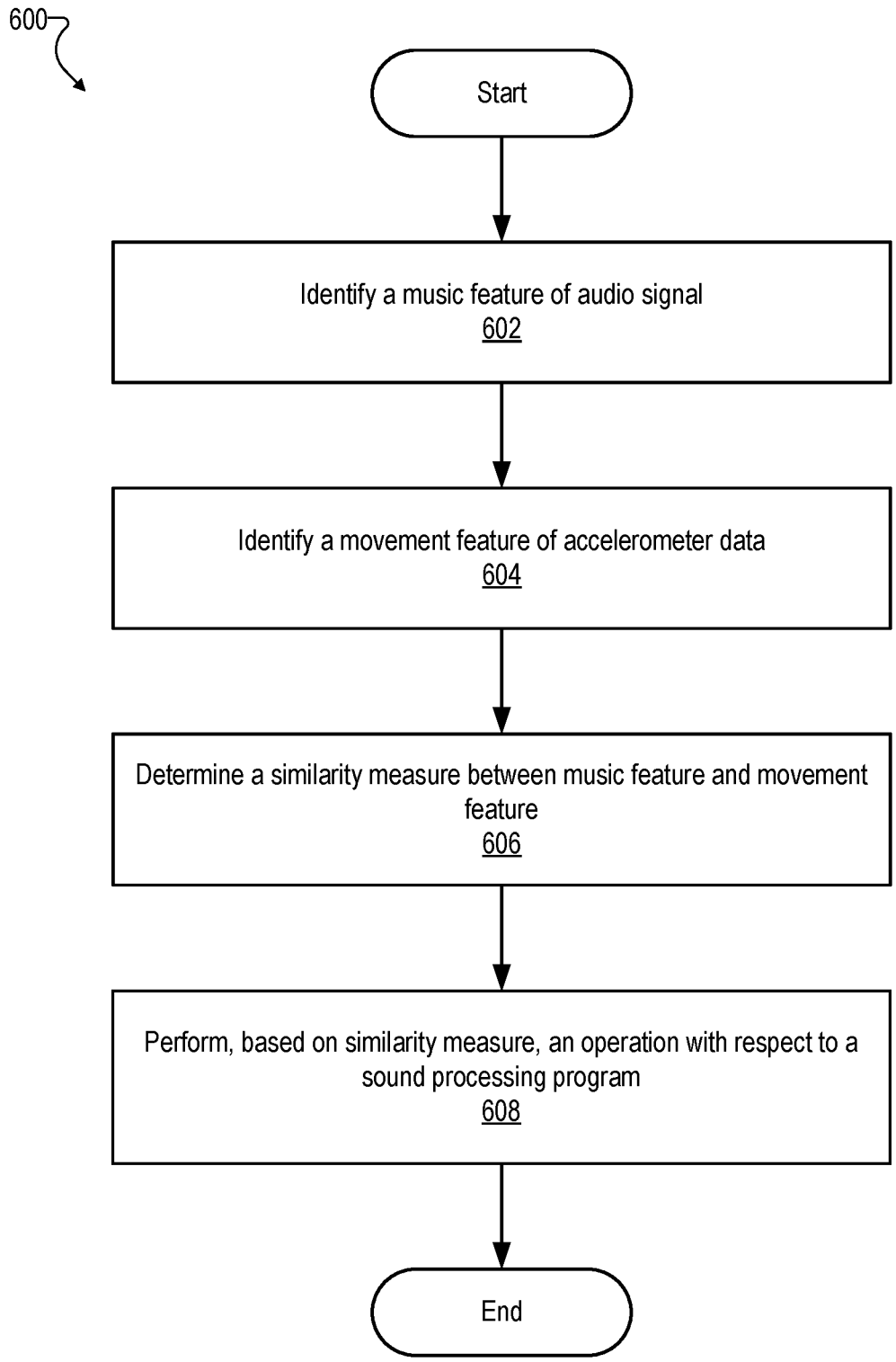
FIG. 6 illustrates an exemplary method according to principles described herein.

FIG. 6 illustrates an exemplary method for accelerometer-based optimization of processing performed by a hearing device. While FIG. 6 illustrates exemplary operations according to one embodiment, other embodiments may omit, add to, reorder, and/or modify any of the operations shown in FIG. 6.

In operation 602, a hearing device identifies a music feature of an audio signal. Operation 602 may be performed in any of the ways described herein.

In operation 604, the hearing device identifies a movement feature of accelerometer data. Operation 604 may be performed in any of the ways described herein.

In operation 606, the hearing device determines a similarity measure between the music feature and the movement feature. Operation 606 may be performed in any of the ways described herein.

In operation 608, the hearing device performs, based on the similarity measure, an operation with respect to a sound processing program (e.g., a music processing program). Operation 608 may be performed in any of the ways described herein.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing device configured to be worn by a user, the hearing device comprising:

a microphone configured to detect an audio signal;

an accelerometer configured to output accelerometer data associated with the hearing device while the microphone detects the audio signal;

a processor communicatively coupled to the microphone and to the accelerometer, the processor configured to:

identify a music feature of the audio signal, the music feature indicating that the audio signal includes music content and including data representative of a rhythm of the music content, identify a movement feature of the accelerometer data, the movement feature representative of movement by the user while the microphone detects the audio signal and including data representative of a rhythm of the movement of the user, determine a similarity measure between the music feature and the movement feature, the similarity measure including a correlation between the music feature and the movement feature, and perform, based on the similarity measure, an operation with respect to a sound processing program executable by the processor.

2. The hearing device of claim 1, wherein the performing of the operation comprises:

identifying settings for the sound processing program, the settings enabling an adaption of the sound processing program to the music content, and performing at least one of:

applying the identified settings to the sound processing program;

storing the identified settings in a memory of the hearing device; and forwarding the identified settings to a service provider, the processor operable to communicate with the service provider.

3. The hearing device of claim 2, wherein the settings comprise a classification of the music content.

4. The hearing device of claim 3, wherein the classification comprises at least one of a genre, a title, a performer, and a composer associated with the music content.

5. The hearing device of claim 2, wherein the settings comprise settings for an audio output of the hearing device that are optimized for the music content.

6. The hearing device of claim 1, wherein the processor is configured to identify a non-music feature of the audio signal, the non-music feature indicating that the audio signal includes non-music content.

7. The hearing device of claim 1, wherein the hearing device further comprises an output transducer communicatively coupled to the processor, the processor configured to provide an audio output signal to the output transducer.

8. The hearing device of claim 1, wherein the processor is configured to perform the operation with respect to the sound processing program by:

determining that the similarity measure is above a threshold similarity level; and initiating, based on the similarity measure being above the threshold similarity level, the operation.

9. The hearing device of claim 1, wherein the processor is configured to perform the operation with respect to the sound processing program by:

determining that the similarity measure is above a threshold similarity level; and lowering, based on the similarity measure being above the threshold similarity level, a threshold to initiate the operation.

10. The hearing device of claim 1, wherein the processor is configured to perform the operation with respect to the sound processing program by:

determining that the similarity measure is below a threshold similarity level; and raising, based on the similarity measure being above the threshold similarity level, a threshold to initiate the operation.

11. The hearing device of claim 1, wherein the processor is further configured to:

identify, based on the music feature, a classification of the music content;

determine that a pattern of similarity measures associated with the classification of the music content is below a threshold; and classify, based on the pattern of similarity measures being below the threshold, the classification of the music content as non-music content.

12. The hearing device of claim 1, wherein the processor is further configured to:

identify, based on the non-music feature, a classification of the non-music content;

determine that a pattern of similarity measures associated with the classification of the non-music content is above a threshold; and classify, based on the pattern of similarity measures being above the threshold, the classification of the non-music content as music content.

13. The hearing device of claim 1, wherein the processor is further configured to:

receive baseline accelerometer data associated with the hearing device while the microphone detects substantially no audio signal;

identify, based on the baseline accelerometer data, a baseline movement feature; and filter the baseline movement feature out of the accelerometer data when identifying the movement feature of the accelerometer data.

14. A hearing device configured to be worn by a user, the hearing device comprising:

a microphone configured to detect an audio signal including music content;

an accelerometer configured to output accelerometer data associated with the hearing device while the microphone detects the audio signal; and a processor communicatively coupled to the microphone and to the accelerometer, the processor configured to:

identify a movement feature of the accelerometer data, the movement feature indicative of a movement by the user toward a source of the music content while the microphone detects the audio signal, and lower, based on the movement feature, a threshold to initiate a music processing program executable by the processor.

15. The hearing device of claim 14, wherein the processor is further configured initiate the music processing program.

16. A method comprising:

receiving, by a hearing device configured to be worn by a user, an audio signal;

receiving, by the hearing device, accelerometer data associated with the hearing device;

identifying, by the hearing device, a music feature and a non-music feature of the audio signal, the music feature and the non-music feature indicating that the audio signal includes both music content and non-music content, the music feature including data representative of a rhythm of the music content;

identifying, by the hearing device, a movement feature of the accelerometer data, the movement feature representative of movement by the user while the hearing device receives the audio signal and including data representative of a rhythm of the movement of the user;

determining, by the hearing device, a similarity measure between the music feature and the movement feature, the similarity measure including a correlation between the music feature and the movement feature; and performing, by the hearing device based on the similarity measure, an operation with respect to a sound processing program executable by the hearing device.

* * * * *